United States Patent [19]

Bouffard et al.

[11] 4,218,973

[45] Aug. 26, 1980

[54] MATERIAL HANDLING APPARATUS FOR PRINTING PLASTIC FILM

[75] Inventors: Alphee J. Bouffard, Fayetteville, Ark.; Alphee T. J. Bouffard, Bolingbrook, Ill.

[73] Assignee: Alpha Associates, Inc., Fayetteville, Ark.

[21] Appl. No.: 907,070

[22] Filed: May 18, 1978

[51] Int. Cl.³ ..... B41F 13/02; B41F 5/06; B41F 5/16

[52] U.S. Cl. ..... 101/181; 101/228; 101/DIG. 21; 242/75.5; 226/30

[58] Field of Search ..... 101/181, 178, 179, 180, 101/182, 219, 228, 176, 220, 225, 138, 139, DIG. 21; 242/75.1, 75.4, 75.5; 226/30, 31, 38, 39, 195

[56] References Cited

U.S. PATENT DOCUMENTS

| | | | |
|---|---|---|---|
| 444,412 | 1/1891 | Lietze | 101/181 |
| 633,967 | 9/1899 | Smith | 101/181 |
| 1,796,912 | 3/1931 | Wood | 242/75.1 |
| 2,111,613 | 3/1938 | Bulford | 101/181 X |
| 2,358,114 | 9/1944 | Stafford et al. | 101/228 |
| 3,239,161 | 3/1966 | Dutro et al. | 242/75.1 |
| 3,995,551 | 12/1976 | Mitter | 101/181 X |

FOREIGN PATENT DOCUMENTS

| | | | |
|---|---|---|---|
| 1132532 | 7/1962 | Fed. Rep. of Germany | 101/178 |
| 6603662 | 9/1966 | Netherlands | 101/181 |

*Primary Examiner*—J. Reed Fisher

*Attorney, Agent, or Firm*—Robert R. Keegan

[57] ABSTRACT

There is disclosed apparatus for printing plastic film including polyvinyl chloride stretchable film which comprises conventional multi-color printing apparatus with multiple cylinders, a transport web threaded through the printing cylinders and other rolls so that plastic film may be laid down on the transport web to be transported through the printing apparatus which also may include a drying section. Special arrangements are provided for laying the plastic film onto the transport web from a supply roll and for pulling it off on a take-up roll. At the supply roll, the rolled sheet is surface driven by a friction contact roll which is in turn driven by friction engagement with one of the rolls for the transport web. The take-up roll is driven by a direct mechanical linkage to the main drive shaft for the printing cylinders. In both the case of the supply roll and the take-up roll, the plastic film is stretched on the order of one to five percent by established differences in the speed of the supply roll or take-up roll and that of the transport web.

4 Claims, 4 Drawing Figures

MATERIAL HANDLING APPARATUS FOR PRINTING PLASTIC FILM

The apparatus according to the present invention is directed to multi-color printing apparatus and particularly the material handling portion of such apparatus associated with feeding thin stretchable plastic film to and from the printing apparatus. The overall apparatus includes multi-color printing cylinders of well known construction and it also includes a transport web in the form of a closed loop passing through the printing rolls, the drying chamber, and past the supply roll and take-up roll. In broad concept, the use of a transport web in a printing apparatus is also known.

The thin, stretchable plastic film self-adheres to the plastic transport web which is of much heavier gauge and much less stretchable. This makes it practical to print in rather fine detail on the stretchable plastic web in multiple colors which would otherwise be quite impossible.

While a transport web thus is very advantageous from one point of view, it also creates problems in laying the stretchable film onto the transport web and also in removing it. Clearly, the care with which the stretchable film is laid on the transport web will directly affect the quality of the printing process. Of similar importance is the take off of the stretchable plastic film, as this film is characteristically wound on large rolls which may then be used in automated packaging machinery. If the finished printed roll is not uniformly wound, it cannot be satisfactorily used in a subsequent packaging operation.

The present apparatus, and in particular the supply-feed portion of the apparatus and the take-off portion of the apparatus, has features which produce a highly practical, rapid, and reliable printing apparatus for thin, stretchable plastic film or other problem materials. Both in moving from the supply roll to the transport web and in moving from the transport web to the finished roll, the plastic film is uniformly stretched (elongated). This is accomplished without resort to complicated servo-mechanisms or other elaborate control systems.

In the case of the supply roll, a contact roll supported on a pair of pivot arms is maintained in contact with the supply roll while the plastic film is fed off the supply roll. In order to impart a slight longitudinal stretch to the plastic film, the surface velocity of the supply roll is determined to be slightly less than the surface velocity of the transport web. This arrangement has been found greatly superior to an arrangement in which the tension in the plastic film is sought to be measured and controlled. There will generally be a particular tension in the plastic film associated with a certain controlled elongation, but the tension itself is not controlled or even measured directly.

While not the only mechanical arrangement that may be employed, the arrangement preferred for the supply roll is a friction drive of the contact roll which frictionally engages the supply roll; the friction drive for the contact roll may conveniently be a very slightly enlarged diameter flange or rim in frictional engagement with one of the rolls for the transport web. This causes the surface speed of the contact roll and hence that of the supply roll to be slightly less than the surface speed of the transport web.

In the case of the take off to the take-off roll, the preferable (but not the only) mechanism for providing the desired longitudinal stretch is the direct drive of a contact roll from the main shaft for the printing cylinders. The printing cylinders also drive the transport web so that with the proper gear ratios in the direct drive of the take-off contact roll, its surface speed can be determined to be slightly greater than the surface speed of the transport web.

As above noted, the preferred apparatus for the particular film printing operations, transport web, etc. has been found to be a friction drive from a transport web roll in the case of the supply roll and a direct drive from the printing cylinders for the take-off contact roll. One may in some cases wish to use one or the other of these mechanisms for both supply and take off. It is possible that cases might arise where the two illustrated arrangements might be utilized in reversed roles with respect to the supply and take-off portions of the material handling apparatus.

As previously mentioned, the broad concept of a carrier web in connection with printing of stretchable plastic material is not new. This is shown, for example, in U.S. Pat. No. 3,977,588 to Meade et al. The patent to Meade, however, does not utilize a loop transport web as in the present invention but rather a long carrier web which must be of a length substantially equal to the length of the stretchable plastic roll. The feed and take off problems are, therefore, quite different in the Meade et al. apparatus. For example, the linear surface velocity of the carrier sheet and product sheet in Meade does not have to be matched to the printing roll surface speed at all times due to the fact that small discrepancies can be smoothed out by idler rolls. In contrast, the present invention provides for a continuous loop transport web operated under uniform constant tension with no idler rolls as such.

The patent to Meade also does not disclose a controlled stretch imparted in laying the stretchable plastic sheet on the carrier sheet or in taking the stretchable plastic sheet off of the carrier sheet. On the contrary, the Meade disclosure proposes a knurled sheet separator roll which, it is said, imparts forces laterally directed across the stretchable web. Carrier webs, some in the form of closed loops, are shown in other patents which do not deal with stretchable film printing in the fashion of the present invention as represented by the following:

| | | |
|---|---|---|
| 1,101,951 | A. J. Oliva | June 30, 1914 |
| 3,840,421 | Everett A. Peterson | Oct. 8, 1974 |
| 3,755,861 | Rodolfo Castro et al. | Sept. 4, 1973 |
| 2,789,498 | R. B. Lew | April 23, 1957 |
| 2,852,252 | P. A. Sperry | Sept. 16, 1958 |
| 2,533,985 | Joseph Aronstein et al. | Dec. 12, 1950 |
| 1,132,532 | WEST GERMANY | July 5, 1962 |

By utilizing a continuous loop transport web and providing means for longitudinally stretching the stretchable plastic sheet both at the time that it is laid onto the transport web and the time it is taken off the transport web, apparatus according to the present invention is capable of rapidly and reliably printing with high quality on generally intractable stretchable plastic polyvinyl chloride sheets or other problem materials.

In addition to providing the features and advantages described above, it is an object of the present invention to provide improved means for feed and take off of stretchable plastic film in a multi-color printing apparatus having a continuous loop transport web.

It is another object of the present invention to provide a product sheet feed apparatus for a multi-color printing press in which the feed velocity of the product sheet is maintained slightly less by a predetermined amount than the velocity of the transport web of the apparatus.

It is still another object of the present invention to provide a take-off mechanism for printed product sheet wherein the velocity of the product sheet is increased by a small predetermined amount in passing from a continuous loop transport web to the finished product roll.

It is yet another object of the present invention to provide such a mechanism wherein the drive of the printed product roll is derived from a direct drive mechanism coupled to the printing rolls of the printing mechanisms.

Other objects and advantages of the present invention will be apparent from consideration of the following description in conjunction with the appended drawings in which.

Figure 1:
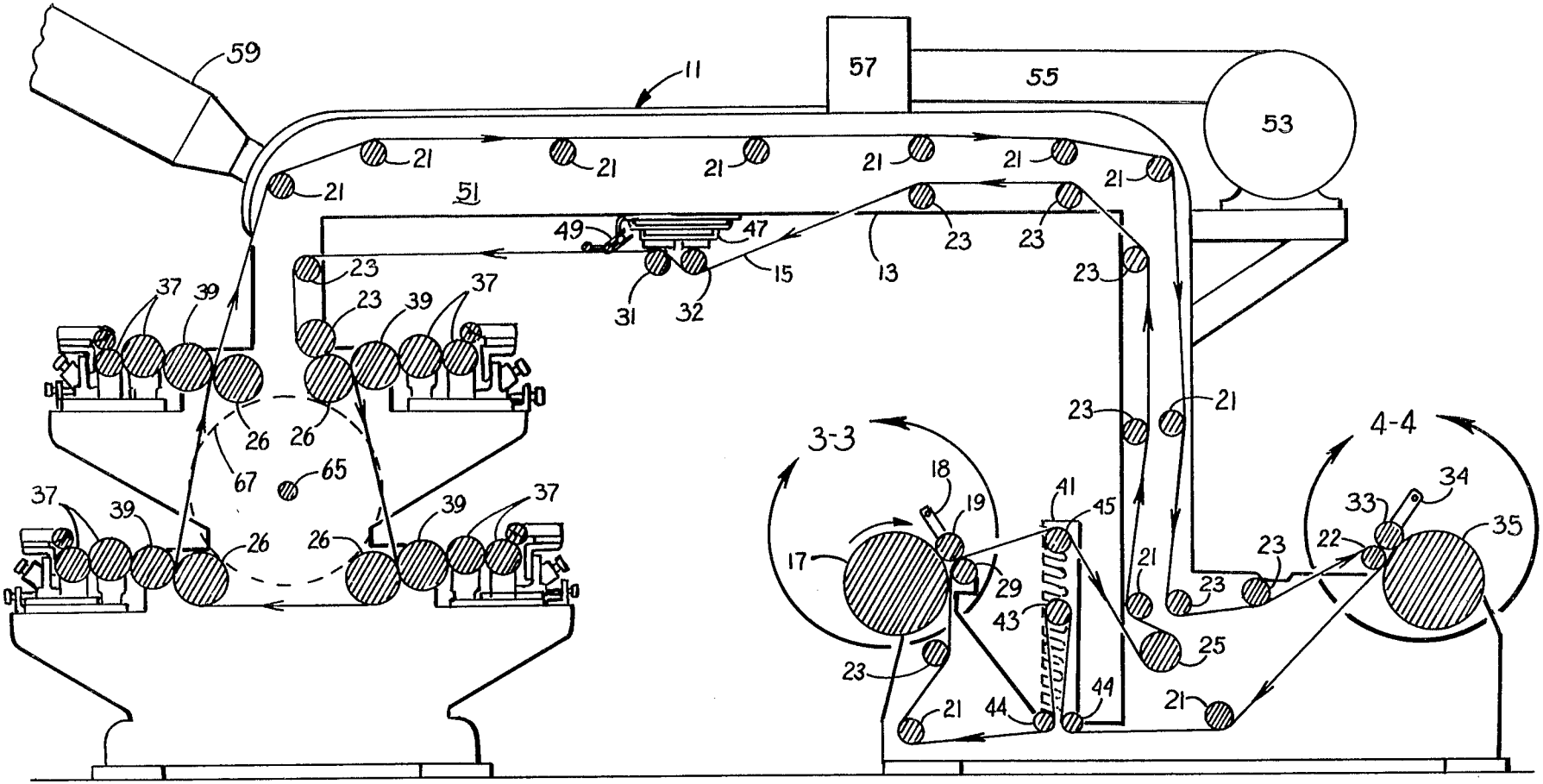
FIG. 1 is an elevational view, partly in section, of apparatus according to the present invention.

Referring to the drawings and particularly FIG. 1, multi-color printing apparatus 11 is shown which is adapted according to the present invention for printing of stretchable film such as polyvinyl chloride. The printing apparatus 11 includes a frame 13 which supports a transport web 15 in the form of a closed loop. The purpose of the transport web 15 is to guide and support the polyvinyl film while it is being printed and dried and to transport the film through the printing and drying sections of the apparatus.

The stretchable film or polyvinyl chloride is supplied from a large roll of such material located at 17, as will later be more fully explained. The film from the roll 17 passes around a contact roll 19 onto the transport web 15. Contact roll 19 is maintained in contact with the supply roll 17 due to the action of gravity and its pivotal mounting on pivot arms 18. Pivot arms 18 may be moved (to the right in FIG. 1) when it is necessary to place a new supply roll 17 onto the apparatus.

Supported on frame 13 are numerous rolls 21 over which the transport web 15 passes; rolls 21 are inside the loop of the transport web. other rolls 23 also guide the transport web and are outside of the transport web serving to guide it in those positions of the path where there is a concavity in the path of the loop as it follows the bridge-like shape of the frame 13.

The rolls 21 and 23 are stationary, and in fact, all of the rolls that guide the transport web 15 are stationary with the exception of a roll 45 just following the sheet path from supply roll 17, and roll 43 which is at the point of the loop in the transport web 15 somewhat before it reaches the contact roll 19. Rolls 45 and 43 are not idler rolls in the usual sense, but they are mounted on a slotted bracket 41 so that they may be selectively positioned in slots of bracket 41 to accommodate differences in transport web loop length. The transport web must be replaced from time to time and this arrangement avoids the necessity of very accurate measurement of the loop length of transport web 15.

By way of illustration transport web 15 may be formed of polyethylene or suitable flexible plastic material of a thickness of between 7 and 10 mils. It may be joined into a loop by pressure sensitive or heat sensitive adhesive tape. The joint in the transport web 15 may be either straight across or slightly on the bias.

Preferably, transport web 15 is placed under substantial tension by adjustment of one or both of rolls 41 and 43. As seen in FIG. 1, a pair of rolls 44 cooperate with roll 43 to create a branch loop in transport web 15 which may be adjusted in length. A stretching force may thereby be imparted by roll 43 which may be, for example, 80 lbs. With a typical width of transport web of 52 inches, this works out to a tension in the web of slightly less than one pound per inch. Tension of from $\frac{1}{4}$ lb. per inch to 4 lbs. per inch may be useful in the transport web 15 in differing circumstances. The large roll 25 may be arranged to be a driven roll driven from the drive of the printing cylinders in the printing apparatus. However, in the preferred embodiment shown, roll 25 is a free-running roll as are rolls 21,23,45,44. Roll 22 is also a free-running roll arranged at the take-off section of the apparatus, which will be explained in more detail hereinafter. Roll 29 is a free-running roll at the feed section which also serves a purpose of acting as a friction drive for contact roll 19 to be later explained. Roll 25 and possibly others of the rolls shown may be omitted or it may be desired to add additional rolls to guide the transport web in some situations.

Cylinders 26 are an integral part of the printing apparatus and are typically impression cylinders. As seen in FIG. 1, there are four such cylinders 26 giving the illustrated apparatus the capability of printing four colors. The invention is also applicable to multi-color printing presses with the capability for printing more than four colors, or less. In fact, the invention would have some advantages in printing only a single color where the registration of the color pattern along the length of the plastic web was required to be quite accurate. This is the case when the printed stretchable film is to be later used on automated packaging machinery and the interval between patterns in the film must be accurate within close tolerances.

The registration of the multi-color pattern within itself is assured by the printing apparatus in which the four impression cylinders 26 and the cylinders 39 associated therewith are all directly driven by a large drive gear 67. This results from the fact that the stretchable film adheres closely to the transport web 15 and the transport web 15 is maintained at uniform tension and hence dimensionally stable as it passes around cylinders 26. In addition to the cylinders 26 and 39, inking cylinders 37 are associated with apparatus of the printing press which are illustrated only schematically in FIG. 1, as their exact configuration does not form a part of the present invention.

As is conventional in printing apparatus for continuous webs, a lateral web guide mechanism is indicated at 47 including an edge sensing device 49 and a pair of rolls 31 and 32 which are pivoted and actuated in response to edge sensing device 49 to maintain the edge of the transport web in accurate alignment as it passes through the printing mechanism including cylinders 26 and 39. The placement of supply roll 17 relative to the transport web 15 determines the distance between the edge of transport web 15 and edge of the stretchable film; this distance is maintained by the feed apparatus. Thus, the printing pattern on the stretchable film may be accurately located laterally on the film, and this position of the printing pattern is maintained by the apparatus including the action of the lateral guide mechanism 47.

The upper portion of frame 13 contains a drying chamber 51 through which the transport web 15 carries the stretchable film after it has been printed with the desired pattern. This is a conventional air duct and is not shown in detail. However, a blower 53 is provided which blows air through a duct 55 and through an optional heater 57. The air together with the vapors driven off from the ink solvent are carried away by an exhaust duct 59.

The printing apparatus is driven through main drive gear 67 by means of electric motor 61 coupled to drive gear 67 through a direct drive mechanism such as a gear drive illustrated at 63. The shaft 65 on which drive gear 67 is mounted is centrally located between cylinders 26 so that they are all driven the same in speed and direction through driven gears (not shown).

Attached to the shaft of one of the cylinders 26 for rotation therewith is a timing belt pulley 69. The motion of rolls 26 and hence of the printing mechanism is transmitted through a timing belt 71 to a gear box 73 through a second timing belt pulley (not shown). The output of gear box 73 is conveyed by shaft 75 to a right angle gear box 79. The shaft 75 is supported with suitable bearings 77. Gear box 79 has connected thereto a rotating shaft 81 communicating with still another gear box 83. Gear box 83 drives a timing belt 85 through a timing belt pulley 87 on a common shaft with a link chain sprocket driving link chain 89. Link chain 89 drives and controls the speed of the take-off mechanism, as will later be seen with reference to FIG. 4. An optional idler sprocket 91 is provided for chain 89.

Figure 3:
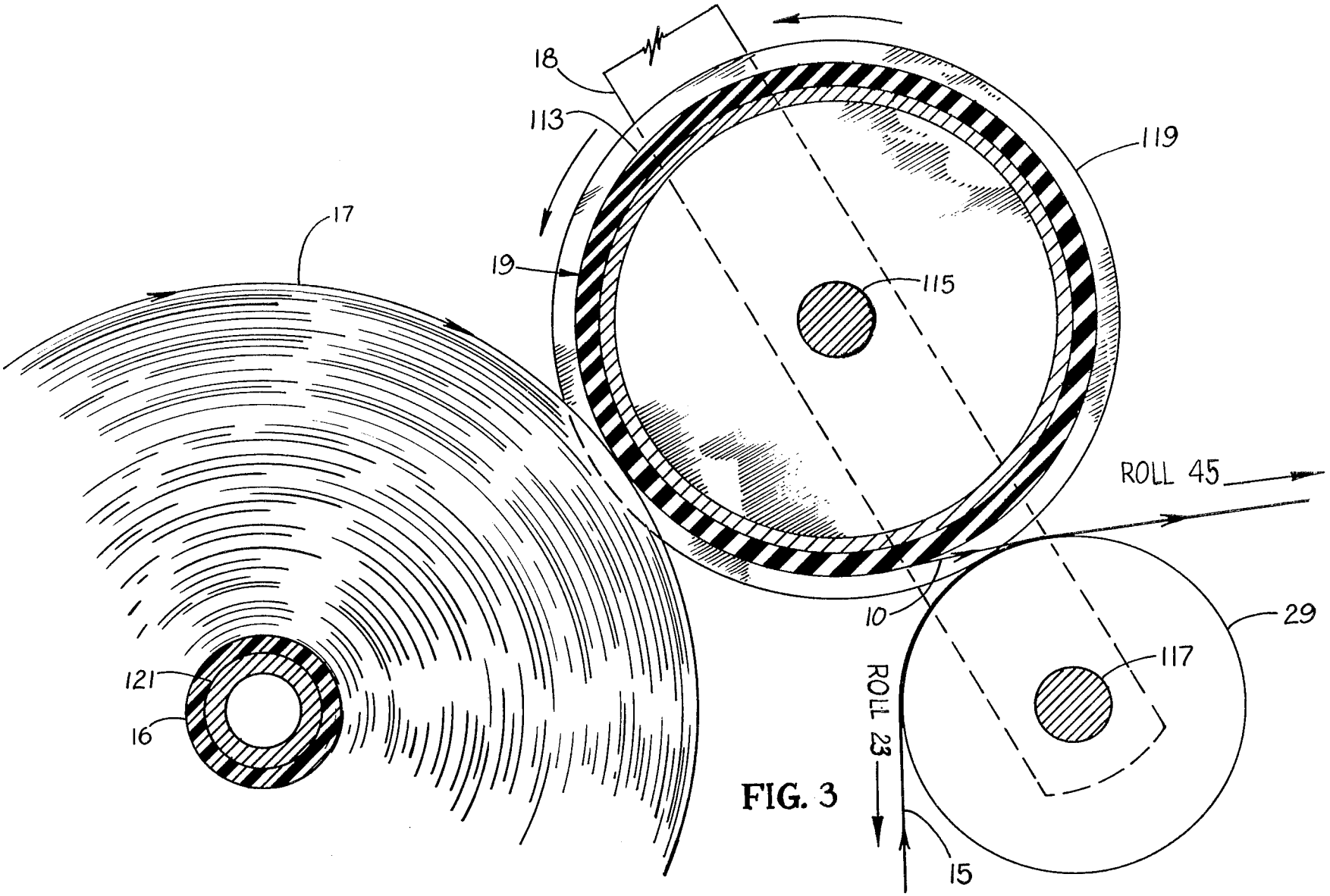
FIG. 3 is a detail view of the feed portion of the apparatus indicated at 3—3 in FIG. 1.

Referring now more particularly to FIG. 3, therein is shown in detail a preferred form of feed mechanism for stretchable plastic film in accordance with the invention. The unprinted supply roll of sheet material 17 is supported on a steel shaft 121 which in turn is supported in bearings not shown so that the material supply roll 17 is free to rotate and pay out the stretchable sheet material.

It is desired that at no time should the pay out of material of roll 17 exceed the speed of the transport web 15. Furthermore, it has been found that the operation of the printing apparatus is significantly enhanced by imparting a controlled stretch to the stretchable sheet material as it is laid onto the transport web 15. The portion of the apparatus illustrated in FIG. 3 accomplishes this result in a remarkably simple and reliable manner.

As seen in FIG. 3, transport web 15 passes approximately vertically from an underlying roll 23 around approximately one-quarter of the periphery of roll 29 and onto adjustable roll 45. Roll 29 is rotatably supported on shaft 117, and the surface velocity of roll 29 is substantially the same as the velocity of web 15.

Feed contact roll 19 is rotatably mounted on shaft 115 which is in turn supported in arms 18. Thus, contact roll 19 is parallel to roll 29 and the axes of the two rolls are a fixed distance apart as determined by the spacing of their bearing openings in arms 18.

Contact roll 19 is, however, movable in position such that its axis may be moved along a circular arc centered on the axis of roll 29. This permits contact roll 19 to maintain contact with supply roll 17 as it diminishes in diameter due to removal of the stretchable plastic film therefrom.

Roll 19 is preferably provided with a frictional surface of rubber, cork, or similar material; this is indicated as a rubber cover 113 in FIG. 3. At one or both ends of roll 19 a rim 119 is located which is of slightly larger diameter than the rubber covered portion of roll 19.

It is the rim 119 of roll 19 which bears against the outer edges of roll 29 so that the peripheral speed of rim 119 of roll 19 is equal to the peripheral speed of roll 29 and hence of transport web 15. Surfaces with a high coefficient of friction could be provided on either rim 119 or on the ends of roll 29, but it is found that metal to metal contact of the steel rolls provides sufficient friction in normal circumstances.

It will be seen that the rotational velocity of the rubber cover 113 on roll 19 is necessarily the same as rim 119 and hence its peripheral velocity must be less than that of rim 119 in the same ratio that its radius is less than that of the radius of rim 119. The rubber surface of roll 19 is in contact with the outer surface of the material on supply roll 17. Thus, the velocity with which the stretchable film is fed from roll 17 is equal to the peripheral velocity of the rubber surface of roll 19. As previously explained, this velocity is related to the velocity of transport web 15 as the radius of the rubber cover 113 is related to the radius of the rim 119 of roll 19. Under varying conditions and for different applications, the difference in speed of the film fed from the supply roll and the speed of the transport web may range from 1% to 10%. In the preferred embodiment illustrated, the speed differential is 2½%. This may be provided, for example, by a radius for rim 119 of four inches and a radius for the rubber cover 113 of roll 19 of 3.9 inches. The size of roll 29 does not enter into the determination of the relation between the speed of the film from the supply roll relative to the speed of the transport web 15.

It will be noted that the stretchable film 10 is unsupported only between roll 29 and roll 19 as shown in FIG. 3. The presence of the stretchable film and its direction of motion are indicated by arrows in FIG. 3 and also in the other figures. As will be apparent from FIG. 3 and the foregoing description, the velocity of the film 10 adhered to web 15 is greater by approximately 2½% than the velocity of the film fed from supply roll 17 and passing around a portion of the surface of roll 19 with the result that a controlled stretch of approximately 2½% is imparted to the film as it is fed onto the transport web 15. For the most part, this stretch takes place in the free standing portion of the film between roll 19 and 29. By way of example, the film 10 may be of a thickness of from 0.0005 to $< 0.0015$ inches and a width of 52 inches.

It has been found that slight stretch of the stretchable film as it is laid onto transport web 15 results in a very smooth surface for the film without wrinkles or bubbles and causes it to pass through the printing section of the apparatus without distortion and at a controlled velocity which assures optimum registration of the vari-colored patterns. It may be noted that the transport web is in the form of a loop and the stretchable film is applied to the outside of that loop. Thus, the tension in the stretchable film due to its being streched when laid onto the transport web causes it to be held against the outer surface of the transport web loop. In addition, the polyvinyl chloride film is self-adhering as one of its basic characteristics. The combination of these two effects assures that the stretchable film moves in perfect unison with the transport web and thus is printed with exact registration and dimensional control, notwithstanding the highly stretchable nature of the film.

It may be further noted that there is no requirement for applying power to the supply roll 17, as its natural tendency would be to feed the film onto transport web 15 under little or no tension, that is at essentially the same speed as the transport web 15. Thus, roll 19 in effect acts as a drag to diminish the relative speed of the periphery of the supply roll 17 while the film paying out of the supply roll 17 produces the clockwise (in FIG. 1) rotation of the roll.

Figure 4:
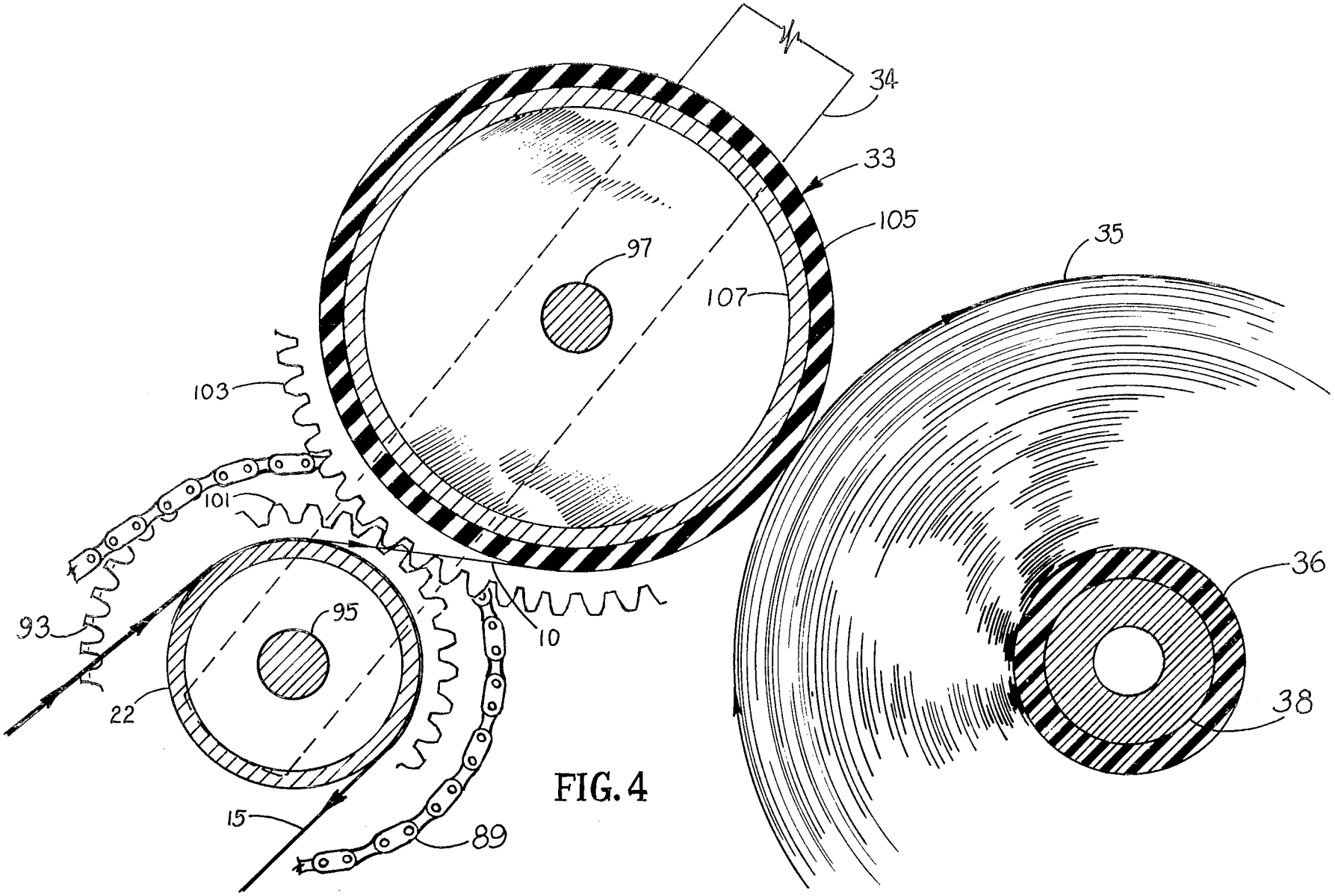
FIG. 4 is a detail view of the take-off portion of the apparatus indicated at 4—4 in FIG. 1.

Referring now particularly to FIG. 4, there is shown in detail the structure of the take off apparatus which removes the stretchable film from contact with the transport web 15 and rolls it smoothly and uniformly on a take up roll 35. The printed stretchable film 10 forms the roll 35 and is rolled on a core 36 which may be of plastic or other suitable material. The roll 35 is supported for free rotation on a shaft 38 near the rightmost extension of transport web 15, as shown in FIG. 1.

As indicated by the arrows in FIG. 1, the stetchable film after having been printed and passed through the drying chamber, moves down on transport web 15 over rolls 21 and around roll 23 to roll 22 where the film is to be removed from the transport web 15, and the transport web reverses direction to return and pick up film from the supply roll in a continuing cycle.

Roll 22 is similar to rolls 21 and 23 may be a smooth steel roll freely rotating on shaft 95. Shaft 95 also acts as the pivot for a pair of arms 34 which support the shaft 97 on which take-off contact roll 33 is rotatably mounted. As will later be described, contact roll 33 is not freely rotatable. In a manner previously described for contact roll 19, roll 33 is preferably provided with a rubber cover 105 or some other material with a high coefficient of friction. The cylinder 107 of roll 33 may be of steel or other alloy giving it the desired rigidity and strength. A gear 103 is secured to cylinder 107 so that gear 103 and roll 33 rotate together. Gear 103 meshes with a gear 101 which is secured to rotate with a sprocket 93. Sprocket 93 engages chain 89 which is driven through the linkage already described from impression cylinder 26 of the printing mechanism.

Figure 2:
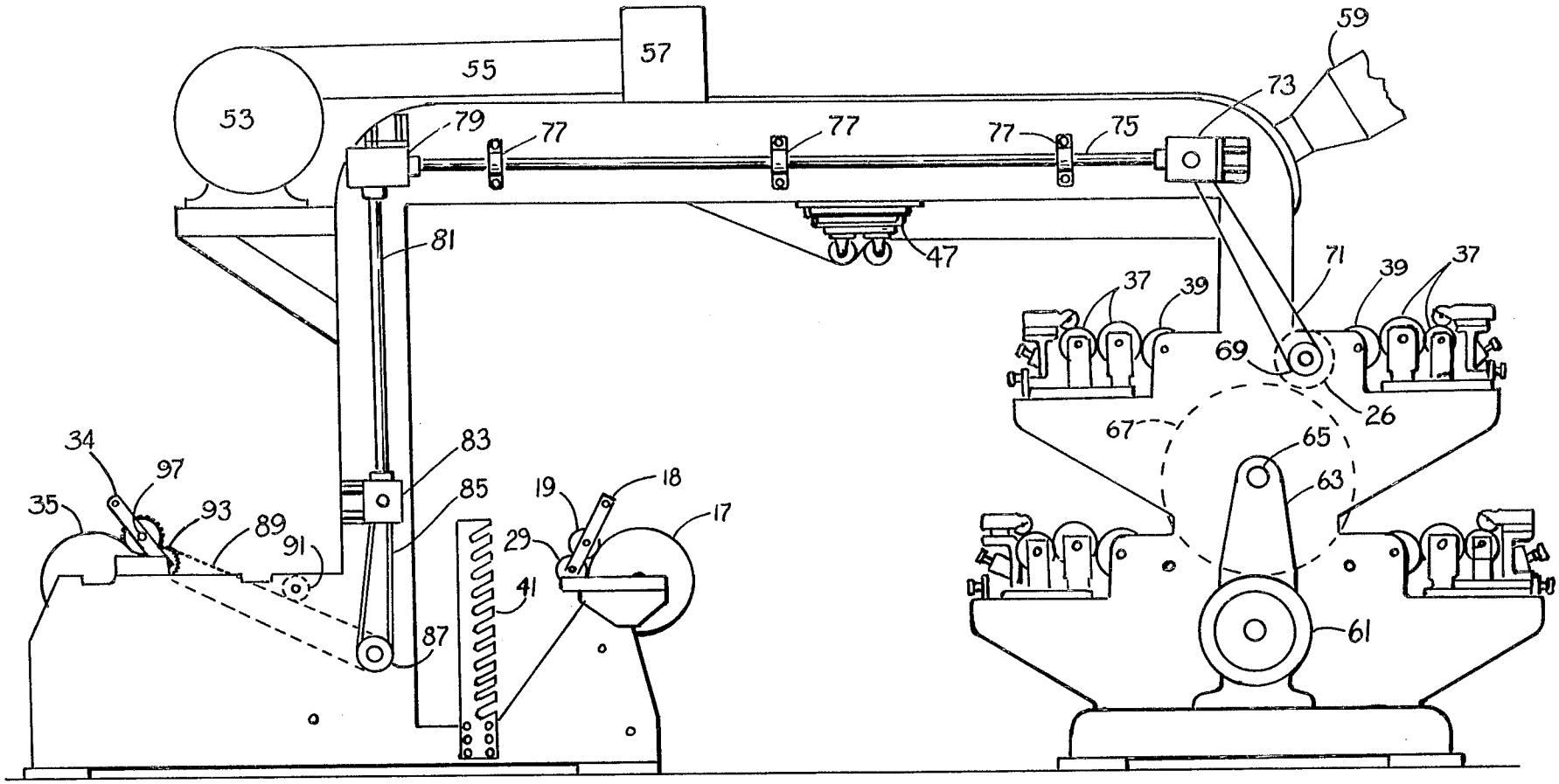
FIG. 2 is an elevational view of the apparatus of FIG. 1 taken from the opposite direction.

Thus, the rotational velocity of roll 33 is directly proportional to the velocity of the impression cylinders of the printing mechanism which in turn drive the transport web 15. In effect then, both roll 33 and transport web 15 are driven by the impression cylinders 26 of the printing mechanism, but the rotational velocity of roll 33 is determined by the composite effect of all gear ratios and chain belt drives as shown in FIG. 2 and described hereinabove. It may be noted that the gear ratios or belt drive ratios of each of the various components of the drive linkage is in itself subject to substantial variation and that only the composite of all the ratios (that is their product) need be determined properly to produce the proper relative speed between the surface of roll 33 and that of transport web 15. According to invention, it is desired that the peripheral speed of the surface of roll 33 be approximately 3% greater than the speed of the transport web 15. The speed of the transport web 15 is, of course, equal to the surface speed of the impression cylinders 26 which is in turn equal to the rotational speed of cylinders 26 times the radius of cylinders 26.

By way of example, assuming that the radius of roll 33 is the same as the radius of the impression cylinders 26, the composite gear ratio for the linkage drive roll 33 may be 31/30. That gear ratio would have to be multiplied by a factor appropriate to compensate for any factor of difference in the radius of roll 33 as compared with the radius of impression cylinders 26.

Roll 33 is in contact with the periphery of take-up roll 35 and is maintained in contact therewith by the pivoting action of arms 34 in a manner similar to that previously described for the feed apparatus with its arms 18. As the film 10 comes off the transport web 15 at roll 22, it passes under roll 33 and onto the take-up roll 35. In the course of this transfer, its velocity is increased by approximately 3% with a concomitant stretching of the film. This has been found to insure smooth and uniform rolling of the film on the finished printed roll. It also insures that the printed patterns are accurately placed on the roll due to the fact that precisely the same stretch is applied to all portions of the roll. It is, of course, necessary to take into account the stretching that takes place after printing if one wishes to highly accurately locate the printed patterns on the finished rolls. That is to say, the printed pattern should be longitudinally compressed by a factor of 30/31 (assuming that is the stretch factor on take off) in order that the pattern after stretching shall be exactly as desired.

In addition to other advantages of the feed and take-off apparatus according to the invention, it will be noted that it provides simple and expedient starting of a roll of film to be printed. This is accomplished by feeding the end of an unprinted roll 17 between rolls 19 and 29 onto the transport web 15, taping the end in a temporary fashion, and running the machine to bring the end around roll 22. The end may thereupon be taped or otherwise fastened to the core 36 for roll 35 and arm 34 lowered to drive the near empty take-off roll 35. Both arms 34 and 38 are, of course, lifted up out of engagement with their respective rolls when the rolls are being changed. When the arms are again in place as shown in FIG. 1 and the film has been fed through as described above, the machine is prepared for operation to print the entire roll of stretchable film material.

Threading a web by hand through the machine is only necessary when it is desired to replace the transport web 15. This is a relatively infrequent operation so that the downtime involved is not serious.

The system described has been found to be very advantageous and free of problems compared to conventional approaches to feed and take off of materials. Such conventional approaches which involve measuring the tension in the sheet to be fed or taken off and making corrections by a servo-mechanism or the like create great difficulties in the handling of stretchable film such as polyvinyl chloride. This stretchable film is first of all subject to be stretched with relatively low applied tension and may of course be stretched substantially with 10%, 20%, or even greater elongation not unusual. Furthermore, the material neither restores immediately upon stretching nor does it permanently deform without restoration. Thus, its action is not readily predictable when subjected to varying tensions.

According to the present invention, the problem is not approached from the point of view of tension but rather from the point of view of stretching or elongating the film. It has been found that controlled stretching which is constant and within a certain range produces reliable, highly repeatable processing of the film by printing or coating. For both feed and take up operations, the roll velocity is determined by a contact roll in contact with the periphery of the supply roll 17 or the take-up roll 35, as the case may be.

In the preferred embodiment the speed of supply contact roll 19 is determined from the speed of adjacent roll 29 which is rotated by the transport web 15. On the other hand, the contact roll 33 for the take-up roll is driven by a direct linkage from the impression cylinders of the printing apparatus. While this particular arrangement is preferred, variations of it are quite possible as previously suggested. In the embodiment shown it will also be noted that the contact roll which controls the speed of the take-off roll or the supply roll also acts as a guide roll for the film as it leaves or joins the supply or take-up roll. This arrangement is convenient but the contact roll used for determining the speed of the supply roll or take-up roll need not be located at the position where the film leaves or joins the roll but could be at any position on the periphery of the roll. Other variations in the apparatus could be made to accommodate it to various printing apparatus, and the material handling portion of the apparatus is not limited to the particular printing apparatus with which it is shown associated in the illustrations.

In addition to those variations and modifications of the invention suggested or described above, other variations or modifications will be apparent to those skilled in the art and accordingly, the scope of the invention is not to be deemed limited to the particular embodiment shown, described, or suggested but is rather to be determined by reference to the appended claims.

What is claimed is:

1. In apparatus for printing on extensible flexible sheet material including a plurality of printing cylinders, a continuous elongated support web for said material passing sequentially under said rolls, a plurality of web rolls with cylindrical surfaces in contact with said web, means for driving at least one of said web rolls and thereby driving said web, a supply roll and a takeup roll for said sheet material, the improvement of flexible sheet supply and takeoff apparatus comprising, a contact roll supported on pivot arms adjacent said supply roll for movement in an arc intercepting the surface of a supply roll of sheet material at both the full and near empty conditions of said roll, said contact roll having a cylindrical surface with a substantial coefficient of friction relative to said sheet material, and means for rotating said contact roll at a speed causing its surface velocity to be a constant factor of from 1% to 10% less than the surface velocity of said support web, said means including a rim integral with said roll of slightly larger diameter than said cylindrical surface and in frictional engagement with the surface of said one of said web rolls.

2. In apparatus for printing on extensible flexible sheet material including a plurality of printing cylinders, a continuous elongated support web for said material passing sequentially under said rolls, a plurality of web rolls with cylindrical surfaces in contact with said web, means for driving at least one of said web rolls and thereby driving said web, a supply roll and a takeup roll for said sheet material, the improvement of flexible sheet supply and takeoff apparatus comprising, a contact roll supported on pivot arms adjacent said supply roll for movement in an arc intercepting the surface of a supply roll of sheet material at both the full and near empty conditions of said roll, said contact roll having a cylindrical surface with a substantial coefficient of friction relative to said sheet material, means for rotating said contract roll at a speed causing its surface velocity to be a constant factor of from 1% to 10% less than the surface velocity of said support web, said means including a rim integral with said roll of slightly larger diameter than said cylindrical surface and in frictional engagement with the surface of said one of said web rolls, a second contact roll supported on arms adjacent said takeup roll for movement on a path intercepting the surface of a takeup roll of sheet material at both the full and near empty conditions of said roll, said second contact roll having a cylindrical surface with a substantial coefficient of friction relative to said sheet material, and means for rotating said second contact roll at a speed causing its surface speed to be a constant factor of from 1% to 10% greater than the velocity of said support web.

3. In apparatus for printing on extensible flexible sheet material including a plurality of printing cylinders, a continuous elongated support web for said material passing sequentially under said rolls, a plurality of web rolls with cylindrical surfaces in contact with said web, means for driving at least one of said web rolls and thereby driving said web, a supply roll and a takeup roll for said sheet material, the improvement of flexible sheet supply and takeoff apparatus comprising, a contact roll supported on pivot arms adjacent said supply roll for movement in an arc intercepting the surface of a supply roll of sheet material at both the full and near empty conditions of said roll, said contact roll having a cylindrical surface with a substantial coefficient of friction relative to said sheet material, means for rotating said contract roll at a speed causing its surface velocity to be a constant factor of from 1% to 10% less than the surface velocity of said support web, said means including a rim integral with said roll of slightly larger diameter than said cylindrical surface and in frictional engagement with the surface of said one of said web rolls, a second contact roll supported on pivot arms adjacent said takeup roll for movement in an arc intercepting the surface of a takeup roll of sheet material at both the full and near empty conditions of said roll, said second contact roll having a cylindrical surface with a substantial coefficient of friction relative to said sheet material, and means for rotating said second contact roll at a speed causing its surface speed to be a constant factor of from 1% to 10% greater than the velocity of said support web, said means including a drive element with a rotational speed proportional to said web speed and concentric with the pivotal axis of said second pivot arms, and a driven element concentric with the axis of said second contact roll and rotationally engaged thereto.

4. In apparatus for printing on extensible flexibel sheet material including a plurality of printing cylinders, a continuous elongated support web for said material passing sequentially under said rolls, a plurality of web rolls with cylindrical surfaces in contact with said web, means for driving at least one of said web rolls and thereby driving said web, a supply roll and a takeup roll for said sheet material, the improvement of flexible sheet supply and takeoff apparatus comprising, a contact roll supported on pivot arms adjacent said supply roll for movement in an arc intercepting the surface of a supply roll of sheet material at both the full and near empty conditions of said roll, said contact roll having a cylindrical surface with a substantial coefficient of friction relative to said sheet material, means for rotating said contact roll at a speed causing its surface velocity to be about 2.5% less than the surface velocity of said support web, said means including a rim integral with said roll of slightly larger diameter than said cylindrical surface and in frictional engagement with the surface of said one of said web rolls.

a second contact roll supported on second pivot arm adjacent said takeup roll for movement in an arc intercepting the surface of a takeup roll of sheet material at both the full and near empty conditions of said roll, said second contact roll having a cylindrical surface with a substantial coefficient of friction relative to said sheet material, and means for rotating said second contact roll at a speed causing its surface speed to be about 3% greater than the velocity of said support web, said means including a drive element with a rotational speed proportional to said web speed and concentric with the pivotal axis of said second pivot arms, and a driven element concentric with the axis of said second contact roll and rotationally engaged thereto.

* * * * *